US006219845B1

(12) United States Patent
Ferriter

(10) Patent No.: US 6,219,845 B1
(45) Date of Patent: Apr. 24, 2001

(54) KNEE PROTECTOR

(76) Inventor: Patrick J. Ferriter, 32 W. 82nd St. #2E, New York, NY (US) 10024-5605

( * ) Notice: Subject to any disclaimer, the term of this patent is extended or adjusted under 35 U.S.C. 154(b) by 0 days.

(21) Appl. No.: 09/480,534

(22) Filed: Jan. 7, 2000

(51) Int. Cl.[7] ..... A41D 13/00

(52) U.S. Cl. ..... 2/24; 280/87.01; 280/87.041; 2/911

(58) Field of Search ..... 2/22, 23, 24, 911; 280/87.01, 87.041

(56) References Cited

U.S. PATENT DOCUMENTS

D. 353,702 * 12/1994 Martinez et al. ..... 280/79.11
718,875 * 1/1903 Pettersen ..... 280/32.5
1,547,166 * 7/1925 Davidson ..... 2/24
2,400,535 * 5/1946 Celmer ..... 280/11.19
2,448,427 * 8/1948 Gordon ..... 280/32.5
2,484,494 * 10/1949 Ferguson ..... 2/24
2,971,769 * 2/1961 Gaddis ..... 280/35
4,772,071 * 9/1988 Richards ..... 2/24
5,014,391 * 5/1991 Schulte ..... 16/35 R
5,377,372 * 1/1995 Rudolf et al. ..... 16/35 R
5,380,021 * 1/1995 Doherty ..... 280/87.04
5,427,391 * 6/1995 Cooper ..... 280/11.19
5,519,916 * 5/1996 Mainard ..... 16/35 R
5,870,774 * 2/1999 Legenstein ..... 2/24
5,937,440 * 8/1999 Ferriter ..... 2/24

* cited by examiner

*Primary Examiner*—Michael A. Neas
*Assistant Examiner*—Gary L. Welch

(57) ABSTRACT

A wheeled support for supporting a kneeling person is provided including a pair of knee supports each having a frame, a pad mounted on the frame, and three wheel assemblies mounted on a bottom of the frame. Also included is a pair of wheeled foot supports.

18 Claims, 2 Drawing Sheets

KNEE PROTECTOR

BACKGROUND OF THE INVENTION

1. Field of the Invention

The present invention relates to knee supports and more particularly pertains to a new knee protector for supporting a keeling person and protecting his or her knees and feet.

2. Description of the Prior Art

The use of knee supports is known in the prior art. More specifically, knee supports heretofore devised and utilized are known to consist basically of familiar, expected and obvious structural configurations, notwithstanding the myriad of designs encompassed by the crowded prior art which have been developed for the fulfillment of countless objectives and requirements.

Known prior art knee supports include U.S. Pat. Nos. 5,380,021; 5,427,391; U.S. Pat. No. Des. 353,702; U.S. Pat. Nos. 4,772,071; 2,971,769; and 718,875.

In these respects, the knee protector according to the present invention substantially departs from the conventional concepts and designs of the prior art, and in so doing provides an apparatus primarily developed for the purpose of supporting a keeling person and protecting his or her knees and feet.

SUMMARY OF THE INVENTION

In view of the foregoing disadvantages inherent in the known types of knee supports now present in the prior art, the present invention provides a new knee protector construction wherein the same can be utilized for supporting a keeling person and protecting his or her knees and feet.

The general purpose of the present invention, which will be described subsequently in greater detail, is to provide a new knee protector apparatus and method which has many of the advantages of the knee supports mentioned heretofore and many novel features that result in a new knee protector which is not anticipated, rendered obvious, suggested, or even implied by any of the prior art knee supports, either alone or in any combination thereof.

To attain this, the present invention generally comprises a pair of knee supports each having a frame. Such frame has a hollow semi-spherical configuration with a closed bottom, an open top and an upper peripheral edge. The frame has a first portion of a pivot connector centrally coupled to an upper surface of the closed bottom thereof for reasons that will soon become apparent. A pair of D-rings are coupled to diametrically opposed points on the upper peripheral edge of the frame. Further, at least one strap is provided with ends having pile fasteners for forming a closed loop to attach to the D-rings of the frame.

The knee supports each have a pad including a hollow semi-spherical configuration with a closed bottom, an open top and an upper peripheral edge. It should be noted that the pad has a size similar to that of the frame. Further, the pad has a second portion of a pivot connector centrally coupled to a lower surface of the closed bottom thereof for releasably coupling with the first portion of the pivot connector on the frame. the first portion of the pivot connector is pivotable with respect to the second portion of the pivot connector for permitting pivoting between the pad and the frame. For attaching the pad and frame to a knee of a user, the pad further has two pairs of straps. Each pair of straps has inboard ends coupled to the upper peripheral edge of the pad in parallel relationship and outboard ends with pile fasteners.

Next provided as a component of each knee support are three wheel assemblies. Each wheel assembly has a bracket coupled to a lower surface of the bottom face of the frame such that a tripod configuration is defined. A fork is defined by a pair of legs and a top face. A post extends upwardly from the top face for being slidably and rotatably coupled within a bore formed in a lower surface of the bracket. Rotatably coupled between the legs of the fork is a malleable wheel. A coil spring is situated about the post between the frame and fork for urging the fork and wheel downwardly. A brake may be provided with a generally U-shaped configuration. The brake is equipped with a pair of ends hingably coupled to the legs of the fork adjacent to an axis of rotation of an associated wheel. A rake is formed in a cross bar of the brake. A disk-shaped tab is integrally coupled to one of the ends of the brake for rotating the same to a lowered orientation with the rake engaging a recipient surface. The brake may further be rotated to a raised orientation with the rake disengaged with the recipient surface.

A pair of foot supports each include an oval sleeve with an open end for allowing the insertion of a foot therein. A rectangular cut out is formed on a top face of the sleeve for accommodating the shape of a human foot. A pair of straps have inboard ends coupled to diametrically opposed edges of the open end of the sleeve and outboard ends with pile fasteners attached thereto. The straps of the foot sleeve are thus adapted for securing the sleeve to a foot of a user. Lastly, a caster wheel is rotatably mounted to a closed end of the sleeve opposite the open end.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new knee protector apparatus and method which has many of the advantages of the knee supports mentioned heretofore and many novel features that result in a new knee protector which is not anticipated, rendered obvious, suggested, or even implied by any of the prior art knee supports, either alone or in any combination thereof.

It is another object of the present invention to provide a new knee protector which may be easily and efficiently manufactured and marketed.

It is a further object of the present invention to provide a new knee protector which is of a durable and reliable construction.

An even further object of the present invention is to provide a new knee protector which is susceptible of a low cost of manufacture with regard to both materials and labor, and which accordingly is then susceptible of low prices of sale to the consuming public, thereby making such knee protector economically available to the buying public.

Still yet another object of the present invention is to provide a new knee protector which provides in the apparatuses and methods of the prior art some of the advantages thereof, while simultaneously overcoming some of the disadvantages normally associated therewith.

Still another object of the present invention is to provide a new knee protector for supporting a keeling person and protecting his or her knees and feet.

Even still another object of the present invention is to provide a new knee protector that includes a pair of knee supports each having a frame, a pad mounted on the frame, and three wheel assemblies mounted on a bottom of the frame. Also included is a pair of wheeled foot supports.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figures 1, 5:
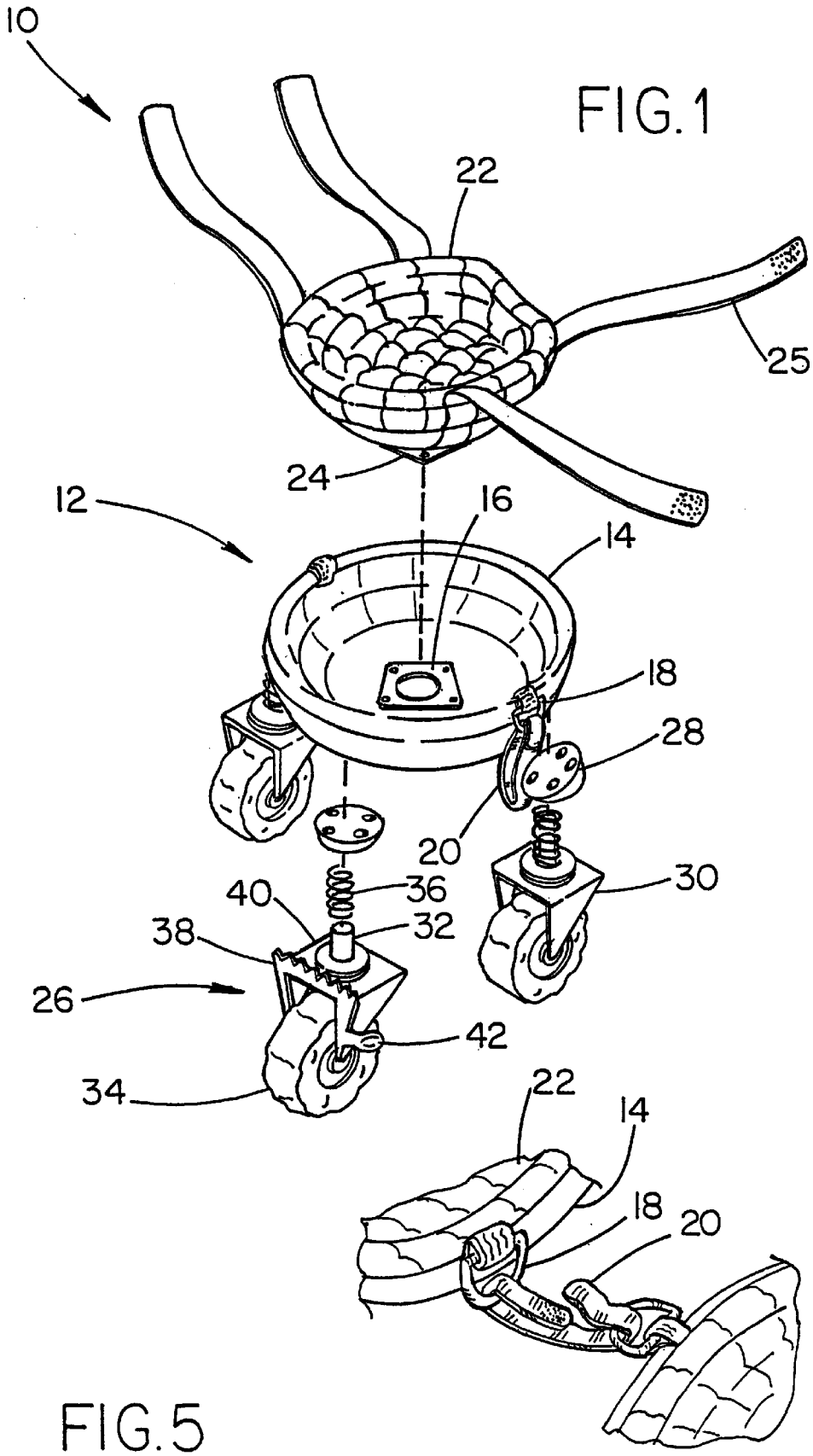
FIG. 1 is an exploded perspective view of a new knee protector according to the present invention.
FIG. 5 is a side view of the interconnection between the wheeled knee supports of the present invention.
Figure 2:
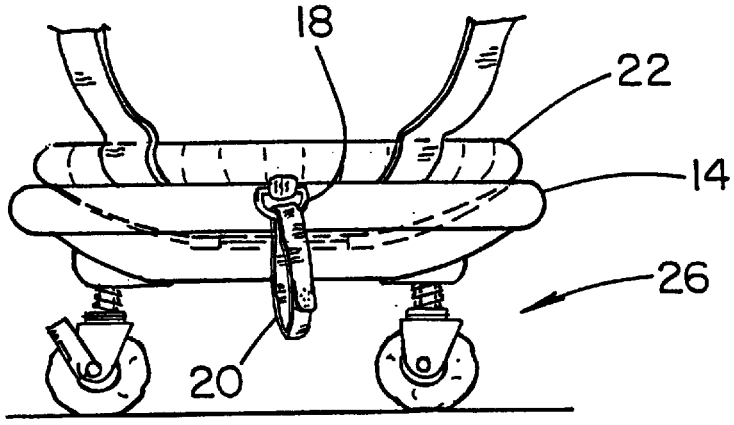
FIG. 2 is a side view of the present invention.

With reference now to the drawings, and in particular to FIGS. 1 through 5 thereof, a new knee protector embodying the principles and concepts of the present invention and generally designated by the reference numeral 10 will be described.

The present invention, designated as numeral 10, includes a pair of knee supports 12 each having a frame 14. Such frame has a hollow semi-spherical configuration with a closed bottom, an open top and an upper peripheral edge. As shown in FIG. 1, the frame has a first portion 16 of a pivot connector centrally coupled to an upper surface of the closed bottom thereof for reasons that will soon become apparent. A pair of D-rings 18 are coupled to diametrically opposed points on the upper peripheral edge of the frame, as shown in FIG. 5. Further, at least one strap 20 is provided with ends having pile fasteners for forming a closed loop to attach to the D-rings of the frame.

With reference again to FIG. 1, it is shown that the knee supports each have a pad 22 including a hollow semi-spherical configuration with a closed bottom, an open top and an upper peripheral edge. It should be noted that the pad has a size similar to that of the frame. Further, the pad has a second portion 24 of a pivot connector centrally coupled to a lower surface of the closed bottom thereof for releasably coupling with the first portion 16 of the frame. The first portion 16 of the pivot connector is pivotable with respect to the second portion 24 of the pivot connector for permitting pivoting between the pad and the frame. The first and second portions of the pivot connector of the frame and pad may rely on a snap coupling, screw coupling or the like. For attaching the pad and frame to a knee of a user, the pad further has two pairs of straps 25. Each pair of straps has inboard ends coupled to the upper peripheral edge of the pad in parallel relationship and outboard ends with pile fasteners. In the preferred embodiment, the frame and pad may be constructed in a variety of sizes.

Next provided as a component of each knee support are three wheel assemblies 26. Each wheel assembly has a bracket 28 coupled to the lower surface of the bottom face of the frame such that a tripod configuration is defined. A fork 30 of each wheel assembly is defined by a pair of legs and a top face. A post 32 extends upwardly from the top face of the fork for being slidably and rotatably coupled within a bore formed in a lower surface of the bracket. The bore of the bracket and an end of the post may be equipped with engaging flanges to prevent the post from being removed from the associated bracket. Rotatably coupled between the legs of each fork is a malleable wheel 34. A coil spring 36 is situated about the post between the bracket and fork for urging the fork and wheel downwardly. As such, the coil spring acts as a shock absorber. In an alternate embodiment, hydraulics may be employed to accomplish a similar objective.

FIG. 1 shows a brake 38 with a generally U-shaped configuration. The brake is equipped with a pair of ends hingably coupled to the legs of the fork adjacent to an axis of rotation of the associated wheel. A rake is formed in a cross bar 40 of the brake. A disk-shaped tab 42 is integrally coupled to one of the ends of the brake for rotating the same to a lowered orientation with the rake engaging a recipient surface. The brake may further be rotated to a raised orientation with the rake disengaged with the recipient surface. In the preferred embodiment, the brake is mounted on a front one of the wheel assemblies.

Figure 4:
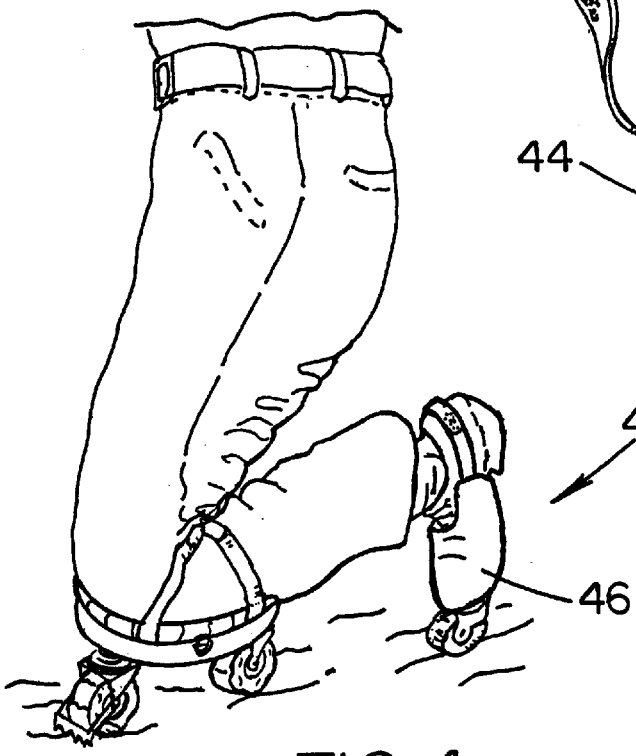
FIG. 4 is a side view of the present invention.
Figure 3:
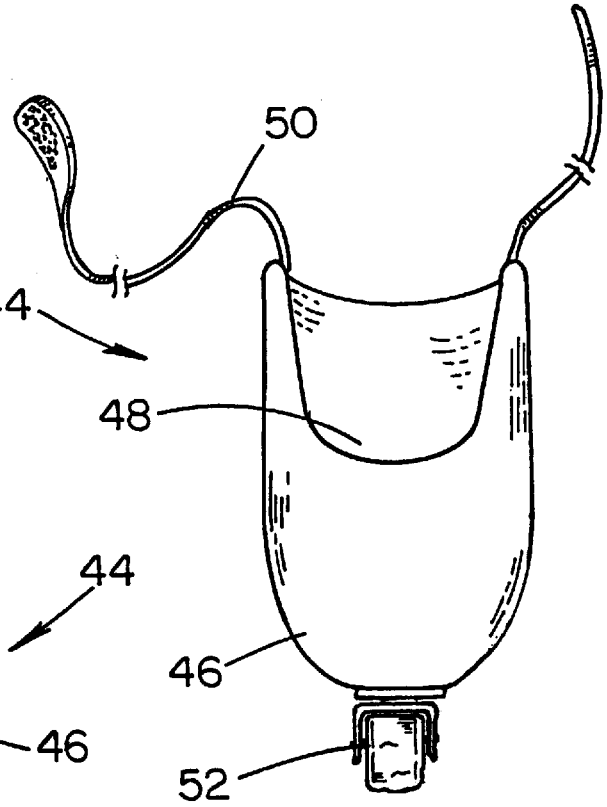
FIG. 3 is a top view of one of the foot supports of the present invention.

With reference now to FIGS. 3 & 4, a pair of foot supports 44 are shown to include an oval sleeve 46 with an open end for allowing the insertion of a foot therein. A rectangular cut out 48 is formed on a top face of the sleeve for accommodating the shape of a human foot. A pair of straps 50 have inboard ends coupled to diametrically opposed edges of the open end of the sleeve and outboard ends with pile fasteners attached thereto. The straps of the foot sleeve are thus adapted for securing the same to a foot of a user. Lastly, a caster wheel 52 is rotatably mounted to a closed end of the sleeve opposite the open end.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A wheeled support system for supporting a kneeling person comprising, in combination:

a pair of knee supports each including:

a frame having a hollow semi-spherical configuration with a closed bottom, an open top and an upper peripheral edge, the frame having a first portion of a pivot connector centrally coupled to an upper surface of the closed bottom thereof, a pair of D-rings coupled to diametrically opposed points on the upper peripheral edge of the frame, and at least one strap with ends having pile fasteners for forming a closed loop to attach to the D-rings of the frame, a pad having a hollow semi-spherical configuration with a closed bottom, an open top and an upper peripheral edge, wherein the pad has a size similar to that of the frame, the pad having a second portion of a pivot connector centrally coupled to a lower surface of the closed bottom thereof for releasably coupling with the first portion of the pivot connector on the frame, the first portion of the pivot connector being pivotable with respect to the second portion of the pivot connector for permitting pivoting between the pad and the frame, the pad further having two pairs of straps each having inboard ends coupled to the upper peripheral edge of the pad in parallel relationship and outboard ends with pile fasteners for attaching the pad and frame to a knee of a user, three wheel assemblies each including a bracket coupled to a lower surface of the bottom face of the frame such that a tripod configuration is defined, a fork with a pair of legs and a top face with a post extending upwardly therefrom for being slidably and rotatably coupled within a bore formed in a lower surface of the bracket, a malleable wheel rotatably coupled between the legs, and a spring situated about the post between the frame and fork for urging the fork and wheel downwardly, and a brake with a generally U-shaped configuration having a pair of ends hingably coupled to the legs of the fork adjacent to an axis of rotation of an associated wheel, a rake formed in a cross bar of the brake, and a disk-shaped tab integrally coupled to one of the ends of the brake for rotating the same between a lowered orientation with the rake engaging a recipient surface and a raised orientation with the rake disengaged with the recipient surface; and a pair of foot supports each including a oval sleeve with an open end for allowing the insertion of a foot therein, a rectangular cut out formed on a top face of the sleeve, a pair of straps having inboard ends coupled to diametrically opposed edges of the open end of the sleeve and outboard ends with pile fasteners attached thereto for securing the sleeve to a foot of a user, and a caster wheel rotatably mounted to a closed end of the sleeve opposite the open end.

2. A wheeled support system for supporting a kneeling person comprising:

a pair of knee supports each including:

a frame with a substantially semi-spherical configuration, a pad with a substantially semi-spherical configuration mounted on the frame, a pivot connector having a first portion coupled to the frame and a second portion coupled to the pad, the first portion being pivotable with respect to the second portion for permitting pivoting between the pad and the frame, the first portion being releasably coupling to the second portion; and three wheel assemblies mounted on a bottom of the frame.

3. A wheeled support system for supporting a kneeling person as set forth in claim 2 wherein each knee support includes a brake.

4. A wheeled support system for supporting a kneeling person as set forth in claim 3 wherein each brake is coupled to one of the wheel assemblies.

5. A wheeled support system for supporting a kneeling person as set forth in claim 2 wherein the wheel assemblies are coupled to the frame in a tripod configuration.

6. A wheeled support system for supporting a kneeling person as set forth in claim 2 wherein each wheel assembly has a cushioning spring.

7. A wheeled support system for supporting a kneeling person as set forth in claim 2 wherein each knee support includes a pair of knee straps.

8. A wheeled support system for supporting a kneeling person as set forth in claim 2 and further including a pair of wheeled foot supports.

9. A wheeled support system for supporting a kneeling person as set forth in claim 2 additionally comprising a connector for releasably connecting the knee supports.

10. A wheeled support system for supporting a kneeling person as set forth in claim 9 wherein the connector includes a strip with a pair of ends having pile fasteners mounted thereon.

11. A wheeled support system for supporting a kneeling person as set forth in claim 9 wherein the connector is connected to the knee supports via closed loop rings.

12. A wheeled support system for supporting a kneeling person as set forth in claim 2 additionally comprising a pair of foot supports each including a sleeve with an open end for allowing the insertion of a foot therein.

13. A wheeled support system for supporting a kneeling person as set forth in claim 12 wherein each of the foot supports includes a pair of straps having inboard ends coupled to opposed edges of the open end of the sleeve and outboard ends with pile fasteners attached thereto for securing the sleeve to a foot of a user.

14. A wheeled support system for supporting a kneeling person as set forth in claim 12 wherein each of the foot supports includes a caster wheel rotatably mounted to a closed end of the sleeve opposite the open end.

15. A wheeled support system for supporting a kneeling person comprising:

a pair of knee supports each including:

a frame with a substantially semi-spherical configuration, a pad with a substantially semi-spherical configuration mounted on the frame, a pivot connector having a first portion coupled to the frame and a second portion coupled to the pad, the first portion being pivotable with respect to the second portion for permitting pivoting between the pad and the frame, the first portion being releasably coupling to the second portion;

three wheel assemblies mounted on a bottom of the frame; and a brake with a generally U-shaped configuration having a pair of ends hingably coupled to one of the wheel assemblies, a rake formed in a cross bar of the brake, and a tab integrally coupled to one of the ends of the brake for rotating the same between a lowered orientation with the rake engaging a recipient surface and a raised orientation with the rake disengaged with the recipient surface.

16. A wheeled support system for supporting a kneeling person as set forth in claim 15 wherein the wheel assemblies are coupled to the frame in a tripod configuration.

17. A wheeled support system for supporting a kneeling person as set forth in claim 15 wherein each wheel assembly has a cushioning spring.

18. A wheeled support system for supporting a kneeling person as set forth in claim 15 wherein each knee support includes a pair of knee straps.

* * * * *